United States Patent [19]

Schellin et al.

[11] 4,058,105

[45] Nov. 15, 1977

[54] SNOWMOBILE SAFETY SWITCH SYSTEM

[75] Inventors: Carl W. Schellin, Deerwood; John P. Lundberg, Pequot Lakes, both of Minn.

[73] Assignee: Scorpion, Inc., Crosby, Minn.

[21] Appl. No.: 677,161

[22] Filed: Apr. 15, 1976

[51] Int. Cl.[2] ..... F02B 77/08

[52] U.S. Cl. ..... 123/198 DC; 200/157; 180/99

[58] Field of Search .... 123/198 D, 198 DC, 198 DB, 123/179 SB; 56/DIG. 15; 180/96, 99; 200/61.85, 61.89, 61.9, 157

[56] References Cited

U.S. PATENT DOCUMENTS

| | | | |
|---|---|---|---|
| 3,417,470 | 12/1968 | Damon | 200/157 X |
| 3,695,379 | 10/1972 | Veilleux | 123/198 D X |
| 3,726,264 | 5/1975 | Lareviere | 123/198 DC X |
| 3,734,230 | 5/1973 | Tanaka | 123/198 DC X |
| 3,742,928 | 7/1973 | Albertson | 123/198 DC X |
| 3,758,736 | 9/1973 | Tanaka | 123/198 DC X |
| 3,789,938 | 2/1974 | Hetteen | 123/198 DB X |
| 3,798,402 | 3/1974 | Raab | 123/198 DC X |
| 3,849,620 | 11/1974 | Melisz | 123/198 DC X |
| 3,881,461 | 5/1973 | Filip | 123/198 DCX |
| 3,980,068 | 9/1976 | Karsten et al. | 123/198 DC |

*Primary Examiner*—Ronald H. Lazarus

*Assistant Examiner*—Ira S. Lazarus

*Attorney, Agent, or Firm*—Dugger, Johnson & Westman

[57] ABSTRACT

A safety switch system for use on snowmobiles that eliminates the hazards of previous systems by providing series connected normally closed switches, one connected directly into the throttle control lever which the operator must press for increasing engine speed from idle, and the other mounted directly on the carburetor and controlled by the throttle control arm which is directly connected to the butterfly valve of the carburetor. The two switches are connected to an engine kill system, such as a ground circuit for the ignition. One of the switches must be open for the engine to be running. This means that when the throttle is open (the carburetor control arm is away from idle position) and the operator's hand is off the throttle control lever the engine is dead. However, with the throttle arm in idle position the engine will run whether the operator has his hand on the manual throttle control lever or not. If the operator has his hand pressing with force on the manual throttle control lever the engine will run whether the carburetor throttle arm is open or closed. The positioning of the control switches eliminates the hazards that can result from mechanical failure of components because of the direct placement of the switches at the critical control locations.

10 Claims, 4 Drawing Figures

FIG. 1
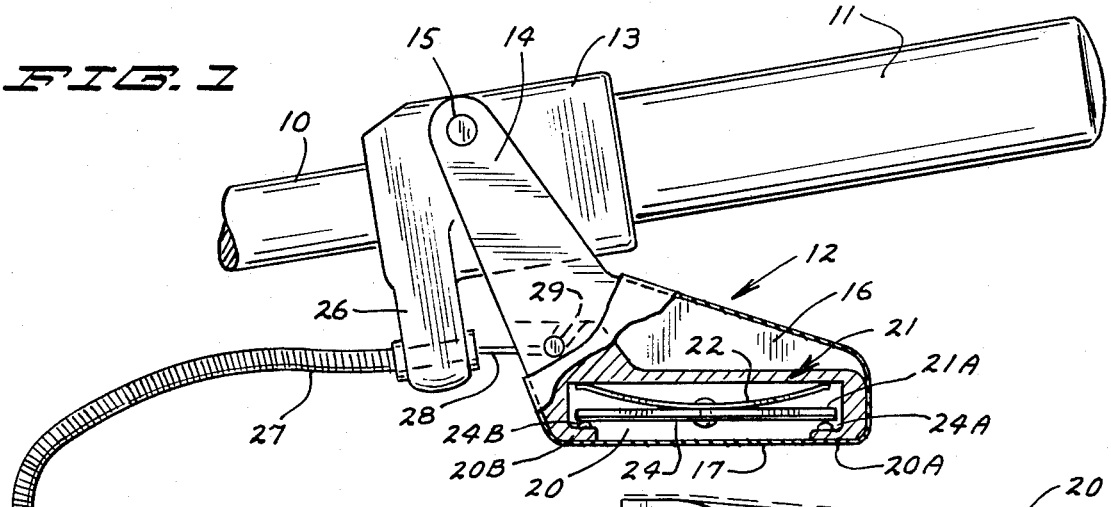
FIG. 3
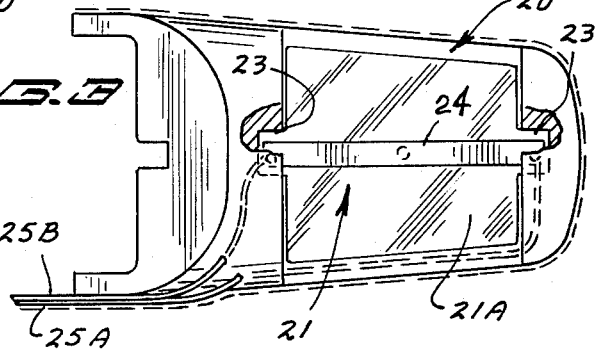
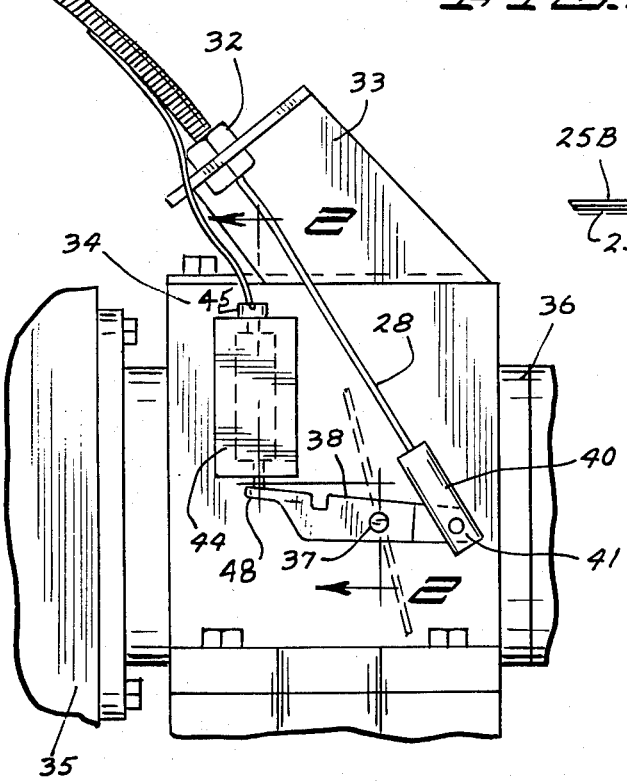
FIG. 2
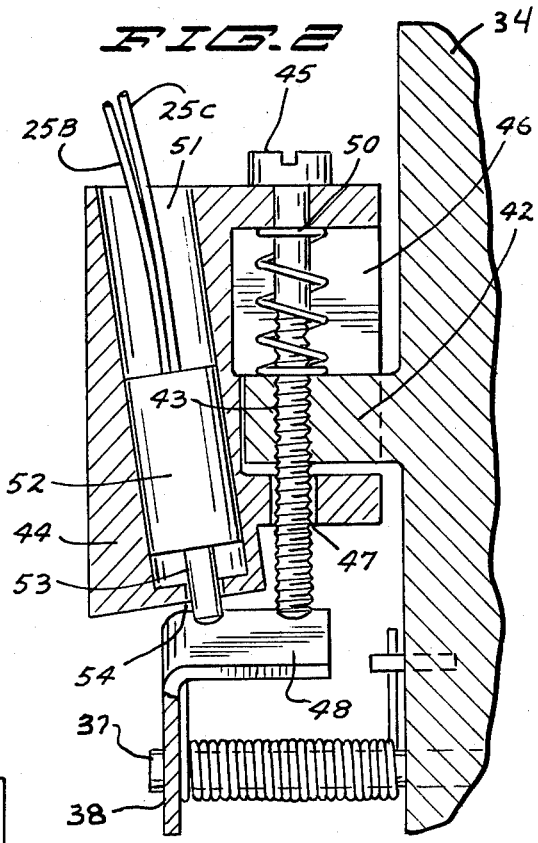
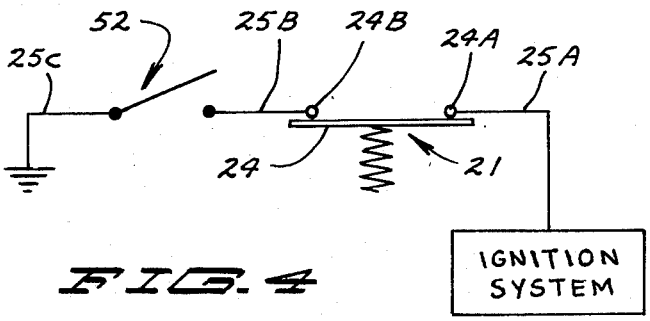
FIG. 4

SNOWMOBILE SAFETY SWITCH SYSTEM

BACKGROUND OF THE INVENTION

1. Field of the Invention

The present invention relates to run-away preventive arrangements for vehicles, such as snowmobiles or other motorized devices.

2. Prior Art

In the prior art, so called "dead man" controls or run away preventing systems have been advanced for many different types of devices. In the U.S. Pat. No. 3,849,620 to Melisz a control which uses two series connected switches, one operated by a separate "dead man" lever on the handle of a power trowel and the other near the throttle control lever on the handle does have two normally closed switches in series that will ground the ignition if both are closed. The unit requires two separate hand actuated levers, one a dead man control, and the other the manual operated throttle control, and does not have a separately controlled switch on the carburetor itself. Also, it must be pointed out that in the device shown in the Melisz patent freezing or binding of the pivot pin for the dead man control can cause malfunction of the safety system, because of the placement of the switches.

U.S. Pat. No. 3,789,938, issued to Hetteen shows a switch arrangement for providing a safety shut off for a snowmobile, but the switches are in parallel. In this particular device, one of the switches is positioned at the throttle arm and it appears that the throttle arm forms one of the contacts of the switch of the carburetor.

The Filip U.S. Pat. No. 3,881,461 shows an automatic cut-off device for vehicles, where two switches have to be operated in sequential operation, and the switches are located in only one location, so that the necessary safety under potential adverse conditions such as the seizing of a throttle control rod, or of the throttle arm would not provide for the desired safety features.

Another type of control, different than the present invention, is illustrated in the Veilleux U.S. Pat. No. 3,695,379. This device, which relates to ignition systems of automobiles is not concerned directly with hand throttle controls, and includes a panic button for stopping the engine.

Other devices uncovered in the preliminary search in this case which generally show the state of the art, include the following U.S. Pat. Nos. 2,550,999 — Hoffman, 3,791,366 — MacMillan, 3,789,402 — Raab, 3,734,230 — Tanaka, 3,672,344 — Albertson, 3,758,736 — Tanaka, 3,845,847 — Camp, 3,303,836 — Burleigh, 2,296,003 — Van Loo, 3,742,928 — Albertson.

SUMMARY OF THE INVENTION

The present invention relates to a safety system for preventing the run-away of vehicles such as snowmobiles. The system comprises an engine kill arrangement which can, for example, ground the ignition system and which uses two series connected, normally closed switches. The switches are located so that mechanical failure such as binding or seizing of lever pivot pins or control cables, or other similar operating problems that occur, will not cause the safety system to malfunction.

A first normally closed switch is placed directly in the operator's throttle control handle or lever and is placed so that whenever the operator's hand is depressing the throttle control for increasing the engine speed the switch will be open. No separate dead man lever is utilized, nor is the switch positioned so that the movement of the lever itself is necessary for operation. The only thing that is necessary for operation of the switch is that there is a pressure on the throttle control lever, which will open the switch.

The switch actuating surface on the throttle control lever encompasses substantially the entire actuating surface of the lever for greater safety and reliability.

A second series connected switch, also normally closed, is mounted in a housing on the carburetor, and the housing is connected to move with the idle adjusting screw. The throttle butterfly valve actuator arm, which normally stops against the idle adjusting screw in idle position has a flange of sufficient width to provide an actuating surface engaging the second switch control button when the throttle arm goes to idle position. Because the housing carrying the second switch moves with the idle adjusting screw, whenever the adjusting screw is changed, the switch control button position is changed as well. Therefore, regardless of idle adjustment, whenever the throttle control arm moves to its idle position, that is, the butterfly valve in the carburetor moves to its idle position, the normally closed switch will be opened. Any position other than the idle position will cause the normally closed switch to close. Thus, if the butterfly shaft should bind open the second switch would be closed. Suitable microswitches are used for the control switches so the switches are reliable and are responsive to only a small amount of movement.

It can thus be seen that the positioning of the control switches is of great importance, and that freezing of a throttle control linkage, such as a cable, will not affect operation, nor will binding of the pivot pin on the throttle hand control lever cause malfunction of the safety system.

If either or both of the switches are open, the engine will be permitted to run. This means that when the operator grasps the throttle control handle, opening the switch there, movement of the throttle control arm away from its idle position to increase engine speed will not activate the kill system. However, if an operator should drop the throttle, for example when falling off the machine, the switch of the throttle hand control lever will close immediately grounding the ignition and stopping the engine unless the throttle arm returns to its idle position. The situation where this would be important is when the butterfly valve might freeze open, and the operator dropped the throttle control. The engine would then be grounded, stopping the sled and avoiding a run-away.

The series connected, normally closed switches for the engine kill system, one of which is positioned to be acted upon directly by the butterfly control arm at the carburetor and the other of which is positioned to be actuated whenever a hand is pressing on the manual throttle control lever directly enhances the safety and reliability of the engine kill system.

BRIEF DESCRIPTION OF THE DRAWINGS

FIG. 1 is a schematic, fragmentary representation of a typical throttle control system embodying the safety kill system of the present invention, with parts in section and parts broken away;

FIG. 2 is a sectional view taken as on line 2—2 in FIG. 1;

FIG. 3 is a front elevational view of the throttle control lever with parts in section and parts broken away; and FIG. 4 is a schematic representation of the circuit of the present invention.

DESCRIPTION OF THE PREFERRED EMBODIMENTS

Reference is made to known, general snowmobile speed control for understanding of the invention as outlined in certain prior art patents listed above. The fragmentary showing of an operator's manual control handle indicated generally at 10 is therefore believed to be sufficient. The control handle 10 is the operator control used for steering the snowmobile, and includes an operator's grip 11 at the outer end of the control handle. As is conventional in many hand controlled vehicles, the operator's handle includes a throttle control indicated generally at 12.

A housing 13 is mounted onto the operator's control handle 10, and a throttle lever 14 is pivotally mounted to the housing 13 on a pivot pin 15, as shown. An operator holding the grip 11 would grasp the throttle control lever 14 adjacent its outer portion indicated generally at 16, normally by placing a thumb on the control surface 17, the covering of which has been broken away and is shown only in dotted lines. The covering would be flexible material or a foam layer, for example. Substantially the entire surface of the outer end portion is part of a receptacle or slot indicated at 20 and as also seen in FIG. 3. The opening is a full width transverse slot, with small overhanging shoulders 20A and 20B. A switch assembly 21 in the throttle control lever includes a plate 21 which is spring mounted with a leaf spring 22. The leaf spring 22 moves in a pair of slots 23 at opposite ends of the slot 20, as can be seen in FIG. 3, so that the plate and spring are held in place when the device is assembled.

The plate 21A also carries an electrical contact strip 24 of a suitable material, that is made to engage contacts 24A and 24B, respectively, attached to the respective shoulders 20A and 20B. The spring 22 thus will urge the plate 21A to a position where the strip 24 is in engagement with both of the contacts 24A and 24B, to complete an electrical circuit path between the two contacts. As will be shown schematically, each of the contacts is connected to a separate electrical wire 25A and 25B, respectivly, as can be seen in FIG. 3.

The mounting housing 13 includes a support portion or ear 26, that retains an outer cable housing 27 of the throttle control cable that mounts a slidable throttle control wire 28. The throttle control wire 28 is connected to lever 14 through a control end 29 fitting into a receptacle in the conventional manner, so that when the manual throttle control lever is pivoted, the throttle control wire 28 will be moved in and out with respect to the housing 27. The throttle is spring loaded to idle position in a normal manner. A torsion spring is shown in FIG. 2.

The other end of the cable housing 27 is attached as at 32 with a pair of lock nuts to a bracket 33 mounted onto a carburetor 34 of conventional design. The carburetor is mounted onto an engine 35 at the intake manifold, and includes an intake air tube indicated generally at 36. The carburetor is of normal design including a butterfly valve indicated in dotted line position that operates in an interior throat or venturi of the carburetor in a conventional manner. The butterfly valve is mounted onto a throttle shaft 37 that pivots to control the position of the butterfly to conrol engine speed. The shaft 37 has a throttle or butterfly valve control arm 38 drivably mounted thereon, and the opposite end of the sliding wire control 28 from connector 29 is connected with a clip 40 to one end of the throttle control arm as at 41.

Referring now specifically to FIG. 2, the carburetor 34 includes an idle screw support ear 42, which has a threaded opening 43. The ordinary idle screw which threads through opening 43 is removed and a housing 44 is installed with a screw 45 threading in opening 43 and holding the housing in position. The housing, as can be seen, has a recess 46 into which the ear 42 slidably fits. The screw 45 is threaded through the opening 43, and through a provided clearance hole 47 in the housing so that the screw engages a tab 48 of the arm 38 in a normal manner to provide the normal idle position of the idle adjusting screw. A coil spring 50 is mounted on the screw, between the top of the ear 42 and the surface defining the top of recess 46, so that the spring 50 will urge the housing 44 upwardly, that is away from the tab 48 of the throttle control arm 38. The housing 44 also includes an opening or receptacle 51 for receiving a normally closed micro-switch 52 which has an actuating plunger 53 protruding through a clearance opening 54 at the bottom of the housing 44. The actuating plunger, as can be seen is positioned at a slight angle with respect to the axis of the idle screw so that the plunger end easily engages the tab 48 on the arm 38. The plunger is positioned so that when the arm 38 is in idle position against the end of screw 45 the plunger will be moved. The switch 52 is epoxied into place in the opening 51, so that once the relative position of the plunger is correlated with the position of the idle screw, whenever the tab 48 backs against the idle screw the plunger 53 will be actuated to open the switch 52.

As can be seen schematically, the wire 25B is connected to the switch, and the wire 25C leading from the switch 52 is connected to a ground.

Referring specifically to FIG. 4, a schematic representation of the circuit is shown. As stated previously, the lead 25C is grounded, as can be seen, and leads to one side of the switch 52 also shown schematically in FIG. 4, is in its open position, that is with the butterfly valve and arm 38 at idle position. The lead 25B leads to one terminal 24B forming part of the switch 21 at the manual throttle lever. The spring loaded connector 21A is shown, connecting to the other contact 24A. Wire 25A which leads to the ignition system is connected to some portion of the ignition wiring which when grounded will disable the ignition.

The following Table I shows the state of the engine in the various positions of the throttle, and the hand. The hand being "on" or "off" refers to the hand touching the throttle control lever and the switch 21. The throttle reference relates to the butterfly valve of the carburetor. "Closed" means it is at idle position and "open" means any position other than idle.

TABLE I

| Throttle | Hand | Switch 52 | Switch 21 | Engine Condition |
|---|---|---|---|---|
| closed | off | open | closed | runs |
| open | off | closed | closed | stop |
| open | on | closed | open | runs |
| closed | on | open | open | runs |

It can thus be seen that with the present arrangement the sensing is done directly at the involved components. Freezing of the control wire 28 in its housing, binding of pivot pins, bending of throttle levers, or similar malfunctions of a mechanical nature will not affect the safety of the present device. In this way, the unit is very reliable, easy to manufacture, and does not interfere with conventional operation of snowmobiles. It does not require additional levers, panic buttons, or dead man control levers at all. It is tied right into existing engine controls, and permits adjustment of engine idle speed in the normal manner but still uses direct sensing at the involved components for safety.

The ground connection acts as an engine disabling connection or means, which is series connected through switch 51 and 21 to the engine control, in this case the ignition system. Other engine disabling controls also could be used, for example, an electric fuel cut-off valve could be energized by series connected switches located in the same positions as those shown.

It should be noted that the last small bit of travel of the throttle arm opens switch 52. Thus if the throttle arm is away from its idle position to any significant degree (when the engine starts to pick up speed) the switch 52 will be closed. Also, if fuel control is achieved with other means than a carburetor one of the switches would be mounted at the final movable member for the fuel control and would be permitted to move to its normal position whenever the full control moved away from idle.

What is claimed is:

1. In an internal combustion engine having a carburetor, a throttle control arm on the carburetor movable from an idle position to working position, and spring loaded toward said idle position, a remote hand throttle actuator engagable by an operator on a surface and movable in response to force on the surface, linkage means between the throttle control arm and the hand throttle actuator to move the throttle control arm away from idle position when the hand throttle actuator is subjected to force from an operator, the improvement comprising an ignition disabling circuit for the internal combustion engine including a pair of switches, each having an open position and a closed position and each normally being spring loaded to the same position as the other, means to position a first of said switches adjacent the throttle control arm so as to be moved from its normal position when the control arm is in idle position, means positioning a second of said switches on said hand throttle actuator whereby said force on said surface sufficient to normally move the hand throttle actuator and connected throttle control arm from idle position moves said second switch from its normal position, and means to connect said first and second switches in series in the ignition disabling circuit whereby when both of said switches are in normal position the ignition system is disabled.

2. The improvement of claim 1 further characterized by said first and second switches normally being in a closed position.

3. The combination as specified in claim 2 wherein the ignition disabling circuit is a grounding circuit and one of said switches has a terminal connected to a ground connection, and the other of said switches is connected to the ignition system to ground said system when both switches are closed.

4. The combination as specified in claim 2 wherein said hand throttle actuator comprises a pivoting lever hving an actuating surface, said second switch being mounted to move with said pivoting lever and including a movable plate, said actuating surface being the surface engagable by an operator and comprising substantially the entire actuating surface of said pivoting lever, said movable plate being positioned so that an operator grasping said control lever and pressing on said actuating surface moves said movable plate.

5. The combination as specified in claim 4 wherein said movable plate includes an electrically conductive strip, and is guided at opposite ends thereof relative to the lever, separate contacts mounted on said lever and positioned at opposite ends of said plate, said contacts being fixed to said lever and engaging said conducting strip at opposite ends thereof when the plate is in a normal position.

6. The combination as specified in claim 5 and spring means to urge said plate toward its normal position and wherein force on the actuating surface of said control lever sufficient to move the control arm away from idle position is greater than the force of said spring means.

7. The combination as specified in claim 1 wherein said carburetor includes an idle adjusting screw, and means for threadably mounting said idle adjusting screw for threadable adjustment to change the idle position of said control arm, said means to position said first switch comprising a housing, means connecting said housing to said idle adjusting screw for movement therewith as said idle adjusting screw for movement therewith as said idle adjusting screw is adjusted, said first switch being mounted in said housing and having an actuator member protruding from said housing, said switch thereby moving with movement of said adjusting screw.

8. A safety system for an operator controlled vehicle having an engine with fuel supply control means on the engine, including a movable control on the engine movable from an idle position in a direction to increase engine speed, an operator throttle control member remote from the engine, said operator throttle control member moving the movable control when subjected to force in an actuator area by an operator when the engine speed is to be increased, an engine disabling circuit including two series connected on-off switches each normally urged to the same position as the other, means to position one switch to be engaged by the movable control and moved away from normal position when the control is in idle position, and a second of said switches being mounted on said operator throttle control member and being actuated away from normal position whenever force sufficient to move the movable control is applied to the actuator area of the operator throttle control.

9. The combination of claim 8 wherein said engine disabling circuit comprises a grounding circuit, and said switches are normally closed.

10. The combination of claim 8 wherein said fuel supply control means comprises a carburetor and said movable control is the throttle butterfly control arm.

* * * * *